United States Patent [19]

Komossa et al.

[11] 4,149,547

[45] Apr. 17, 1979

[54] MECHANISM FOR ORIENTING TOBACCO IN TOBACCO CUTTING MACHINES

[75] Inventors: Werner Komossa, Börnsen; Uwe Elsner, Dassendorf; Gerhard Schlie, Hamburg, all of Fed. Rep. of Germany

[73] Assignee: Hauni-Werke Korber & Co. KG., Hamburg, Fed. Rep. of Germany

[21] Appl. No.: 787,575

[22] Filed: Apr. 14, 1977

[30] Foreign Application Priority Data

Apr. 5, 1976 [DE] Fed. Rep. of Germany ..... 2619594

[51] Int. Cl.[2] ..... A24B 7/24; B65G 47/24

[52] U.S. Cl. ..... 131/109 AB; 198/382; 198/533

[58] Field of Search ..... 193/2 B; 198/533, 382; 222/198, 200, 202, 227, 233; 302/56; 241/224, 225; 131/108, 109 R, 109 AB; 19/105

[56] References Cited

U.S. PATENT DOCUMENTS

| | | | |
|---|---|---|---|
| 1,174,979 | 3/1916 | Heiderich | 193/2 B X |
| 2,446,752 | 8/1948 | Fiddyment | 198/533 |
| 3,577,844 | 5/1971 | Towery | 19/105 X |
| 3,722,747 | 3/1973 | Petit | 222/198 X |
| 4,037,712 | 7/1977 | Wochnowski | 198/572 X |

FOREIGN PATENT DOCUMENTS

| | | | |
|---|---|---|---|
| 2321998 | 11/1973 | Fed. Rep. of Germany | 222/233 |

*Primary Examiner*—Robert B. Reeves
*Assistant Examiner*—James L. Rowland
*Attorney, Agent, or Firm*—Peter K. Kontler

[57] ABSTRACT

A tobacco cutting machine wherein two endless chain conveyors define a horizontal channel of diminishing height for conversion of tobacco into a cake whose leader advances into the range of and is shredded by orbiting knives. The lower chain conveyor extends rearwardly beyond the upper chain conveyor and is located below the lower end of a vertical passage which is defined by an upright duct having several mobile walls which flank different portions of the passage and are pivotably mounted in the housing of the cutting machine. One of the mobile walls is located immediately above the rearwardly extending portion of the lower chain conveyor and is oscillated at a high frequency by an eccentric drive. Another mobile wall of the duct is located above the one mobile wall or directly above the rear end of the upper chain conveyor and is oscillated by a second eccentric drive at a lower frequency but through larger angles. This insures that tobacco leaves which are showered into the open upper end of the duct are free to move relative to each other during downward movement in the duct and thereupon advance edgewise into and in the channel to form a laminated cake of predictable density before the leaves reach the path of orbiting knives.

10 Claims, 2 Drawing Figures

Fig.1
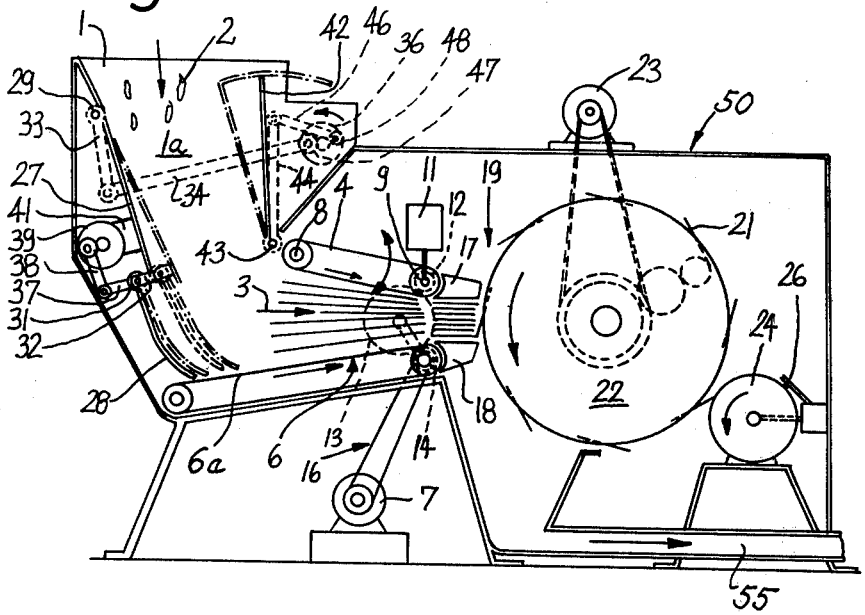
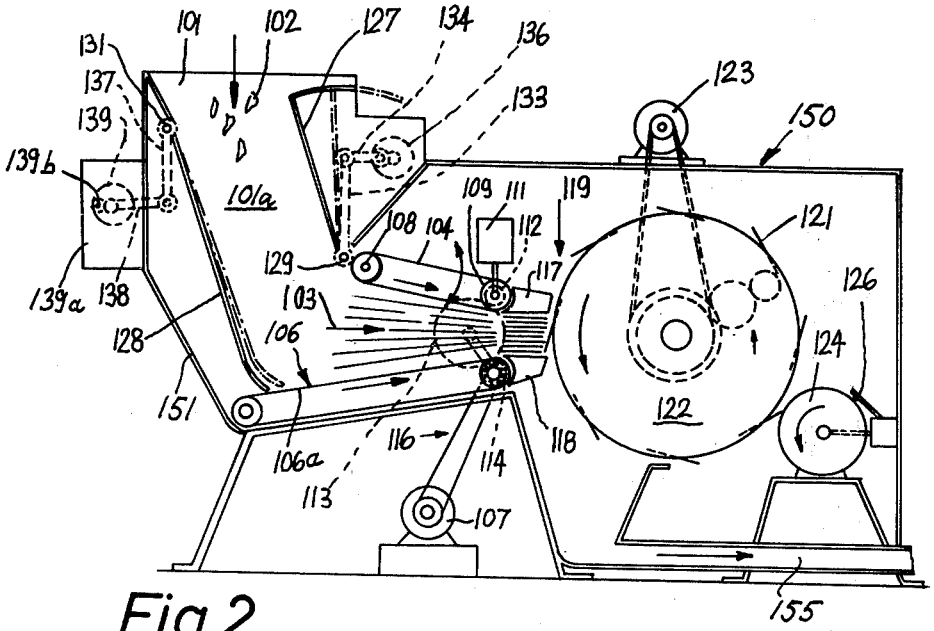
Fig.2

MECHANISM FOR ORIENTING TOBACCO IN TOBACCO CUTTING MACHINES

BACKGROUND OF THE INVENTION

The present invention relates to tobacco cutting or shredding machines in general, and more particularly to improvements in tobacco cutting machines of the type wherein two convergent endless chains or analogous conveyors define a substantially horizontal channel wherein tobacco leaves or portions of tobacco leaves (including ribs, reconstituted tobacco or laminae) are converted into a cake whose leader is fed into the range of orbiting shredding knives.

The channel in a machine of the above outlined character normally receives tobacco from an upright duct which is located above the rearwardly extending portion of the lower conveyor. The duct includes at least one mobile wall or rake which is moved at regular intervals to push descending tobacco particles or leaves into the rear end of the channel. At least the majority of descending tobacco particles are caused to change the direction of their movement (from substantially vertical to substantially horizontal) when they reach the rear portion of the lower conveyor or the layer of tobacco particles on such rear portion. In order to insure that the leader of the cake in the horizontal channel between the conveyors is invariably compacted to an optimum degree or that the extent of densification is within an acceptable range, the front portion of the upper conveyor is normally urged toward the front portion of the lower conveyor by means of a yieldable biasing device, such as a dashpot, a set of springs or a fluid-operated motor.

It has been found that heretofore known tobacco cutting machines are incapable of producing a tobacco cake whose consistency is sufficiently predictable to insure a continuous satisfactory shredding action. A phenomenon which is observable in presently known machines is the development of cavities in the cake. Such cavities develop in response to interruption of the shower or stream of tobacco particles which descend in the duct toward the rear portion of the lower conveyor. Another reason for the formation of an unsatisfactory tobacco cake is unpredictable orientation of tobacco particles (particularly whole leaves or tobacco leaf laminae) in the channel between the upper and lower conveyors. If the plane of a tobacco particle is substantially normal to the direction of movement of the cake toward the knives, the knives are likely to extract the entire particle without any comminuting action.

The critical zone of the path along which tobacco particles travel from the inlet of the duct toward the outlet of the channel between the conveyors is the region above the rear portion of the lower conveyor. In such region, the particles of tobacco are caused to change the direction of their movement from vertical to horizontal (i.e., through approximately 90 degrees). The particles which descend in the rear portion of the passage of the duct (i.e., in that portion of the duct which is remotest from the knives) must cover a greater distance on their way toward and into the channel between the conveyors than the particles which descend immediately behind the rear end of the upper conveyor. This results in unpredictable and widely different degree of change of orientation of particles with attendant lack of proper stratification of particles in the cake.

OBJECTS AND SUMMARY OF THE INVENTION

An object of the invention is to provide a tobacco cutting machine which is provided with means for insuring predictable orientation of tobacco particles which form the cake.

Another object of the invention is to provide a novel and improved tobacco feeding and agitating duct for tobacco shredding machines.

A further object of the invention is to provide a machine wherein the orientation of particles is controlled in a predictable manner and by resorting to simple instrumentalities.

An additional object of the invention is to provide the machine with novel and improved means for effecting a change in direction of movement of tobacco particles in the region where the particles leave the duct and enter the channel between the cake forming conveyors.

An ancillary object of the invention is to provide a tobacco cutting machine wherein the shredding tool or tools cannot extract whole tobacco leaves or large portions of tobacco leaves from the leader of the cake which is formed by the conveyors.

A further object of the invention is to provide a novel and improved method of converting a shower or stream of tobacco particles (which may constitute portions of or entire leaves) into a tobacco cake of predictable density and consistency.

The invention is embodied in a tobacco cutting machine, particularly in a machine which is used for shredding of tobacco leaf laminae. The machine comprises an upper and a lower conveyor each of which preferably constitutes a chain conveyor. These conveyors define a substantially horizontal tobacco condensing channel having an outlet and diminishing in height in a direction toward the outlet. The rear portion of the lower conveyor (i.e., that portion which is remote from the outlet) extends beyond the upper conveyor, and the machine further comprises an upright tobacco feeding and agitating duct which defines a tobacco delivering passage having a lower end behind the upper conveyor above the rear portion of the lower conveyor and communicating with the channel between the conveyors. The duct comprises a plurality of walls including mobile first and second walls which bound different portions of the passage. The machine also comprises means for imparting to the first wall recurrent movements at a first frequency and means for imparting to the second wall recurrent movements at a higher second frequency. The duct preferably further comprises first and second pivots for the respective mobile walls; the recurrent movements then constitute oscillatory (pivotal) movements of the mobile walls about the axes of the respective pivots.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic partly elevational and partly longitudinal vertical sectional view of a tobacco cutting machine which embodies one form of the invention and whose duct comprises three mobile walls; and FIG. 2 is a similar schematic partly elevational and partly sectional view of a second machine wherein the duct comprises two mobile walls.

DESCRIPTION OF THE PREFERRED EMBODIMENTS

Referring first to FIG. 1, there is shown a tobacco cutting machine which is similar to that known as type "KT" produced by HAUNI-WERKE KORBER & CO. KG., of Hamburg, Federal Republic Germany. The machine comprises a substantially upright tobacco feeding and agitating duct 1 with open upper and lower ends. Tobacco 2 (preferably tobacco leaf laminae) is supplied to the upper end of the duct 1 by a suitable conveyor which is not shown in the drawing, e.g., by a carded conveyor which draws tobacco from a bin. The width of the passage 1*a* which is defined by the walls of the duct 1 diminishes in a direction toward the lower end of the duct which is located at a level above the rear portion 6*a* of an endless chain conveyor 6 cooperating with a shorter upper endless chain conveyor 4 to define a substantially horizontal channel 3 whose height diminishes in a direction away from the open lower end of the duct 1. The conveyors 4 and 6 compact and thus convert tobacco 2 into a cake whose leader issues from the outlet of the passage 3 and is severed by the orbiting knives 21 of a rotary drum-shaped carrier 22 driven by an electric motor 23 which is mounted on the top wall of the housing 50 of the machine. Tobacco 2 in the channel 3 is advanced by the lower reach of the upper conveyor 4 and the upper reach of the lower conveyor 6. These conveyors are driven by a discrete prime mover 7 (e.g., a variable-speed electric motor) through the medium of a chain drive 16. The drive 16 rotates the front sprocket wheel of the lower conveyor 6 and the latter drives the front sprocket wheel 9 of the upper conveyor 4 through the medium of a gear train 12, 13, 14.

The upper chain conveyor 4 is mounted in a frame (not shown) which is secured to the housing 50 by a pivot member 8 which constitutes the shaft for the rear sprocket wheel of the conveyor 4. The front portion of the frame, and hence the front sprocket wheel 9 of the conveyor 4, is urged downwardly toward the front sprocket wheel of the conveyor 6 by a pneumatic cylinder and piston unit 11 or an analogous yieldable biasing device to insure that the density of the cake in the channel 3 is constant when the cake reaches the path of the knives 21. These knives are sharpened by a grinding wheel 24 which is treated by a diamond 26 or another suitable dressing tool.

The machine further comprises a mouthpiece 19 including a lower section 18 which is mounted in the housing 50 and constitutes a counterknife for the knives 21, and an upper section 17 which is mounted on the frame for the upper chain 4, i.e., the section 17 is movable toward and away from the section 18.

The rear portion 6*a* of the lower chain conveyor 6 closes the lower end of the duct 1 and cooperates with a mobile wall 28 of the duct to direct tobacco 2 into the channel 3. The upper portion of the wall 28 is turnable about the axis of a pivot 31, and such upper portion is adjacent to the lower portion of a second mobile wall 27 whose pivot 29 is located at the open upper end of the duct 1. The walls 27 and 28 flank that side of the passage 1*a* which is remote from the rear end of the upper conveyor 4. The front side of the passage 1*a* (above the rear end of the conveyor 4) is flanked by a further mobile wall 42 of the duct 1; this wall is turnable about the axis of a pivot 43 which is adjacent the rear end of the conveyor 4.

The pivot 31 for the lower rear wall 28 of the duct 1 is mounted on a holder 32 which is secured to the lower portion of the wall 27. The pivot 29 is a shaft which is rigid with the upper end portion of a link 33 the lower end portion of which is articulately connected to a connecting rod 34. The latter is coupled to an eccentric pin 47 of a disk 36 which is driven by the motor 7, by the motor 23 or by a discrete prime mover, not shown. The disk 36 has a second eccentric pin 48 for a connecting rod 46 which is articulately connected to a link 44 rigid with the pivot 43 for the lower end portion of the wall 42. When the disk 36 is driven, the walls 27 and 42 perform recurrent oscillatory movements between the solid-line and phantom-line positions of FIG. 1. The pivot 43 is not only rigid with the link 44 but also with the wall 42. The same applies for the pivot 29, wall 27 and link 33.

The means for imparting recurrent oscillatory movements to the wall 28 at a frequency which is higher than the frequency of recurrent movements of the wall 27 includes a driven disk 39 which is mounted on a holder 41 secured to the lower portion of the wall 27, a connecting rod 38 which is articulately connected to an eccentric pin of the disk 39 and a link 37 which is articulately connected with the rod 38 and is rigid with the pivot 31 for the wall 28. It will be seen that the lower rear wall 28 of the duct 1 shares the recurrent movements of the upper rear wall 27 and is also movable (at a higher frequency) relative to the wall 27. When the upper wall 27 moves between the end positions which are respectively indicated by solid and phantom lines, the wall 28 moves between the positions which are indicated by solid and broken lines. Movements of the wall 28 relative to the wall 27 take place between the end positions which are respectively indicated by solid and broken lines on the one hand, and phantom lines on the other hand. The disk 39 can receive motion from a motor which is mounted on the holder 41 or from one of the aforementioned motors.

The amplitude of recurrent movements of the lower wall 28 under the action of the disk 39 is less pronounced than the amplitude of movements of the walls 27, 42 under the action of the disk 36. The free upper end of the wall 42 is adjacent to the upper end of the duct 1 and is preferably provided with a baffle which directs stray particles of tobacco 2 into the passage 1*a*. The pins 47 and 48 of the disk 36 are located diametrically opposite each other, i.e., the upper end of the wall 42 moves away from the pivot 29 when the lower end of the wall 27 moves away from the inlet of the channel 3, and vice versa.

The operation:

The aforementioned supply conveyor delivers a continuous shower of tobacco 2 into the upper end of the duct 1. Such tobacco descends toward the rear portion 6*a* of the lower chain conveyor 6 and the mobile walls 27, 42 move toward and away from each other to thus prevent or practically eliminate the likelihood of bridging of tobacco in the passage 1*a*. This is due to the fact that the mobile walls 27, 42 alternately enlarge and reduce the volume of the upper part of the duct 1, and their movements also promote the descent of particles toward the rear end of the channel 3.

The particles of tobacco 2 which reach the rapidly oscillating lower rear wall 28 of the duct 1 are caused to change direction even before they reach the conveyor portion 6*a*, and the pulsating action of the wall 28 reduces friction between neighboring tobacco particles to thus eliminate any remaining cavities (if any) in the partially densified mass of descending tobacco. The moving wall 28 further reduces the likelihood of interruption of the stream of particles which descend toward the conveyor 6, and the wall 28 also causes a change in orientation of particles, namely, the particles tend to move toward the mouthpiece 19 in such a way that their general planes are horizontal or nearly horizontal. This allows for more predictable and reproducible compacting of tobacco 2 into a cake even if the device 11 biases the front portion of the conveyor 4 with a relatively small force. In fact, the bias of the device 11 can be reduced to 50 percent or less of the bias which is needed in conventional tobacco cutting machines to guarantee a satisfactory shredding action. This is attributable to the novel orientation of tobacco particles in the channel 3, i.e., the particles are stratified in such a way that the cake in the channel 3 does not appreciably influence the height of the outlet of the channel 3. In other words, the distance between the sections 17, 18 of the mouthpiece 19 is not appreciably influenced by the cake. Reduction of the bias upon the front portion of the conveyor 4 is desirable because this results in considerable reduction of wear upon the conveyors 4 and 6. In fact, the aforedescribed construction of the duct 1, coupled with high-frequency oscillation of the wall 28 and low-frequency oscillation of the walls 27, 42, renders it possible to produce a satisfactory cake even if the rate of tobacco feed into the passage 1*a* fluctuates within an extremely wide range.

The mounting of the rapidly oscillating lower rear wall 28 on the upper rear wall 27 simplifies the task of selecting an optimum ratio of frequencies for these walls. The upper wall 27 (in cooperation with the mobile front wall 42) insures a predictable downward movement of tobacco 2 into the range of the lower wall 28, and the latter insures a predictable orientation and preliminary compacting of tobacco which is about to enter the channel 3. The mounting of the wall 28 on the lower portion of the upper rear wall 27 exhibits another advantage, namely, the entire composite rear wall 27-28 acts upon the descending particles in a manner which eliminates eventual cavities in the descending shower and causes or allows the batches or clumps of particles to disintegrate before they reach the inlet of the channel 3. The major part of the vibrating action which is imparted to the descending particles takes place in front of the rapidly oscillating lower rear wall 28.

FIG. 2 shows a modified machine wherein all such parts which are identical with or clearly analogous to corresponding parts of the machine of FIG. 1 are denoted by similar reference characters plus 100. In the second apparatus, the wall 128 extends practically all the wall from the upper end to the lower end of the duct 101 and is oscillated at a relatively high frequency by a disk 139 whose motor 139*a* is mounted at the outer side of a stationary wall 151 of the duct 101 and has an eccentric pin 139*b* for the connecting rod 138. The wall 127 is oscillated at a lower frequency by the parts 129, 133, 134, 136. Thus, the two mobile walls 127, 128 of the duct 101 respectively flank the front and rear sides of the passage 101*a* and the lower end portion of the wall 128 is immediately or closely adjacent to the upper reach of the rear portion 106*a* of the lower chain conveyor 106. The extent of pivotal movement of the relatively short wall 127 exceeds the extent of pivotal movement of the longer wall 128; however, the frequency of movement of the wall 128 is higher.

An important advantage of the improved tobacco cutting machine is that the particles of tobacco which move into the range of orbiting knives 21 or 121 advance edgewise rather than sideways. This insures that the knives cannot extract whole leaves or large portions of leaves, i.e., that the pneumatic evacuating conveyor 55 or 155 invariably receives shredded tobacco. Moreover, the improved machine insures that the knives 21 or 121 can properly shred the leader of a cake practically immediately after the machine is started so that the quantity of unsatisfactory tobacco which enters the conveyor 55 or 155 immediately after the respective machine is started is reduced to a small fraction of unacceptable material in conventional machines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In a machine for cutting tobacco particles including tobacco leaves, the combination of an upper and a lower conveyor, said conveyors defining an elongated tobacco condensing channel having an outlet and diminishing in height in a direction toward said outlet, said lower conveyor including a portion extending rearwardly beyond said upper conveyor; a duct arranged to feed a stream of randomly distributed tobacco particles and defining a tobacco delivering passage having a lower end behind said upper conveyor above said portion of said lower conveyor and communicating with said channel so that successive increments of the stream which reach said portion of said lower conveyor are deflected into said channel, said duct comprising a plurality of walls including mobile first and second walls bounding different portions of said passage, said second wall extending downwardly to the general level of said portion of said lower conveyor; means for imparting to said first wall recurrent movements at a first frequency to thereby alternately increase and reduce the volume of successive increments of the stream in said channel with attendant relative movement of tobacco particles and at least some equalization of density of the stream; means for imparting to said second wall recurrent movements at a higher second frequency to effect further relative movement and stratification of particles in an orientation in which the particles in said channel move edgewise and undergo gradual densification with attendant conversion of said stream into a cake; and means for shredding successive increments of said cake.

2. The combination of claim 1, wherein said duct further comprises first and second pivots for the respective walls, said recurrent movements constituting oscillatory movements of said mobile walls about the axes of the respective pivots.

3. The combination of claim 1, wherein said passage has a first side and a second side located opposite said first side, said mobile walls being adjacent said first side and said second wall being located at a level below said first wall.

4. The combination of claim 3, wherein said first side of said passage is remote from said upper conveyor.

5. The combination of claim 3, wherein said passage has an open upper end and said duct further comprises first and second pivots for the respective mobile walls, said first pivot being adjacent said upper end and said first wall having a lower end portion, said second pivot being adjacent the lower end portion of said first wall.

6. The combination of claim 1, further comprising means for articulately connecting said second wall to said first wall so that said second wall shares the movements of and moves relative to said first wall.

7. The combination of claim 1, wherein the means for imparting movements to one of said mobile walls is mounted on the other of said mobile walls.

8. The combination of claim 1, wherein said channel has a first side adjacent to and extending upwardly from said upper conveyor and a second side located opposite said first side, said first wall bounding said first side and said second wall bounding said second side of said passage.

9. The combination of claim 8, wherein said passage has an upper end and said duct further comprises first and second pivots for the respective mobile walls, said first pivot being adjacent said upper conveyor and said second pivot being adjacent to said upper end.

10. A method of cutting tobacco particles including tobacco leaves, comprising the steps of conveying a stream of randomly oriented tobacco particles downwardly along a first path; alternately increasing and reducing the volume of successive increments of said stream at a first frequency to thereby effect relative movements between neighboring particles and at least some equalization of density of the stream; deflecting successive increments of the equalized stream from said first path into a second path; moving successive deflected increments along said second path and simultaneously agitating the particles of tobacco at a higher second frequency during deflection from said first into said second path so as to further promote relative movement between neighboring particles with attendant stratification of particles in such orientation that the particles move edgewise; progressively condensing the stratified particles in said second path to thereby convert said stream into a moving cake; and converting successive increments of the cake into shreds.

* * * * *